US007802605B2

(12) United States Patent
Prismall

(10) Patent No.: US 7,802,605 B2
(45) Date of Patent: Sep. 28, 2010

(54) RETRACTABLE BARRIER SYSTEM

(75) Inventor: Ian James Prismall, Hungerford (GB)

(73) Assignee: Primac Limited (GB)

( * ) Notice: Subject to any disclaimer, the term of this patent is extended or adjusted under 35 U.S.C. 154(b) by 320 days.

(21) Appl. No.: 10/543,205

(22) PCT Filed: Feb. 9, 2004

(86) PCT No.: PCT/GB2004/000517

§ 371 (c)(1),
(2), (4) Date: Mar. 27, 2006

(87) PCT Pub. No.: WO2004/070117

PCT Pub. Date: Aug. 19, 2004

(65) Prior Publication Data

US 2006/0162872 A1 Jul. 27, 2006

(30) Foreign Application Priority Data

Feb. 8, 2003 (GB) ..... 0302921.2

(51) Int. Cl.
*A47H 1/00* (2006.01)

(52) U.S. Cl. ..... 160/24; 160/29; 160/120; 160/135

(58) Field of Classification Search ..... 160/199, 160/196.1, 206, 186, 187, 120, 24, 25, 29; 4/557, 558, 607, 608, 610; 49/125, 126, 49/127, 128, 394, 409, 404, 425; 52/243.1, 52/79.1; 24/590.1; 256/1, 32, 13.1, 23; 404/6, 404/9, 11; 211/105.1, 123; 280/47.9; D34/26; 206/315

See application file for complete search history.

(56) References Cited

U.S. PATENT DOCUMENTS 1,106,624 A * 8/1914 Cadwallader et al. ..... 47/22.1
2,221,357 A * 11/1940 Moore et al. ..... 160/135
3,187,761 A * 6/1965 De Maio ..... 135/118
3,369,589 A * 2/1968 Benkert, Jr. ..... 160/84.04
3,917,231 A * 11/1975 Fink ..... 256/64
4,119,301 A * 10/1978 Payne ..... 256/41
4,124,196 A * 11/1978 Hipskind ..... 256/1
4,186,912 A * 2/1980 Byrd, Jr. ..... 256/1
4,533,122 A * 8/1985 Bannister ..... 256/69
4,723,663 A * 2/1988 Learn ..... 211/59.2
4,844,420 A * 7/1989 Oster ..... 256/1
5,020,196 A * 6/1991 Panach et al. ..... 24/590.1
5,029,819 A * 7/1991 Kane ..... 256/24
5,050,846 A * 9/1991 Goodman et al. ..... 256/1
5,269,623 A * 12/1993 Hanson ..... 404/6

(Continued)

FOREIGN PATENT DOCUMENTS

| | | | |
|---|---|---|---|
| CH | 622117 A5 | * | 3/1981 |
| EP | 0 678 626 | | 10/1995 |
| FR | 2 706 499 | | 12/1994 |
| FR | 2706499 A1 | * | 12/1994 |
| FR | 2 714 404 | | 6/1995 |
| GB | 2 179 384 | | 3/1987 |
| WO | WO 97 13049 | * | 4/1997 |
| WO | WO 00 49231 | * | 9/2000 |

OTHER PUBLICATIONS

Vertical Post Storage Cart, May 10, 2010: http://www.crowdcontrolwarehouse.com/index.asp?PageAction=VIEWCATS&Category=93.*

*Primary Examiner*—Katherine W Mitchell
*Assistant Examiner*—Jaime F Cardenas-Garcia
(74) *Attorney, Agent, or Firm*—Skinner and Associates

(57) ABSTRACT

A retractable barrier system comprises a plurality of barrier posts interconnectable by flexible barrier material, and a dispenser device upon which the posts can be carried and from which the posts can be dispensed, in sequence, to erect a barrier.

20 Claims, 5 Drawing Sheets

U.S. PATENT DOCUMENTS 5,322,306 A * 6/1994 Coleman ..... 280/33.992
5,704,592 A * 1/1998 White et al. ..... 256/25
5,875,597 A * 3/1999 Gingrich et al. ..... 52/239
6,089,302 A * 7/2000 Britt ..... 160/98
6,135,423 A * 10/2000 Johnson ..... 256/1
D447,888 S * 9/2001 Chao ..... D6/462
6,375,164 B1 * 4/2002 Siegler et al. ..... 256/1
6,474,903 B1 * 11/2002 Marts et al. ..... 404/6
6,520,712 B2 * 2/2003 Kulp et al. ..... 404/9
6,575,435 B1 * 6/2003 Kotzen ..... 256/24
6,682,055 B1 * 1/2004 Tomlinson et al. ..... 256/1
6,733,204 B1 * 5/2004 Paniccia ..... 404/6
6,807,999 B1 * 10/2004 Bowen et al. ..... 160/24
6,971,329 B1 * 12/2005 Stewart ..... 116/63 C
7,082,981 B2 * 8/2006 Perez, Jr. ..... 160/24
7,217,061 B2 * 5/2007 Stratton ..... 404/6
2002/0063248 A1 * 5/2002 Siegler et al. ..... 256/37
2003/0009954 A1 * 1/2003 Bradley ..... 52/79.1

* cited by examiner

FIG 15
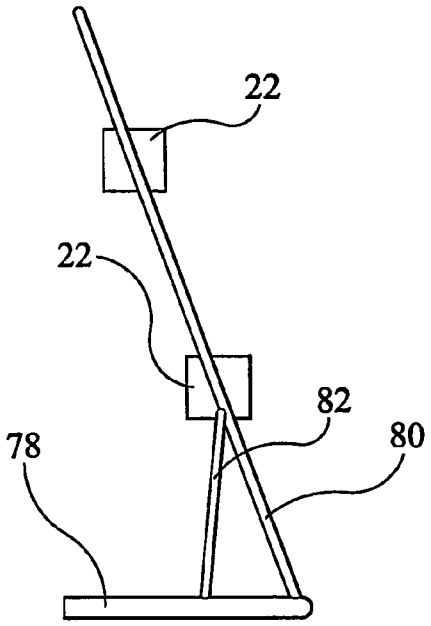
FIG 16
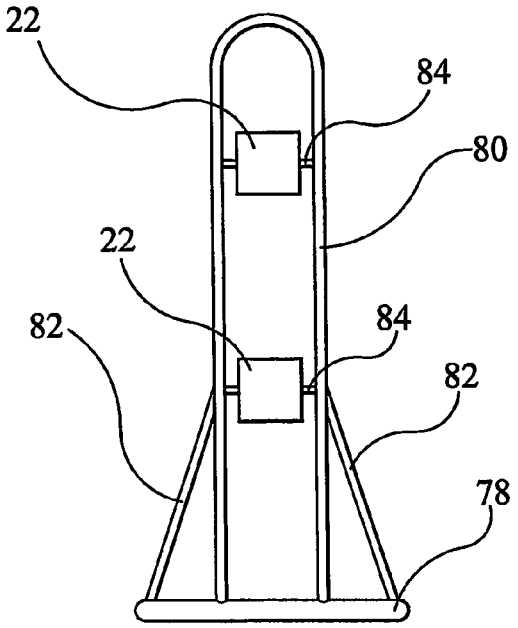
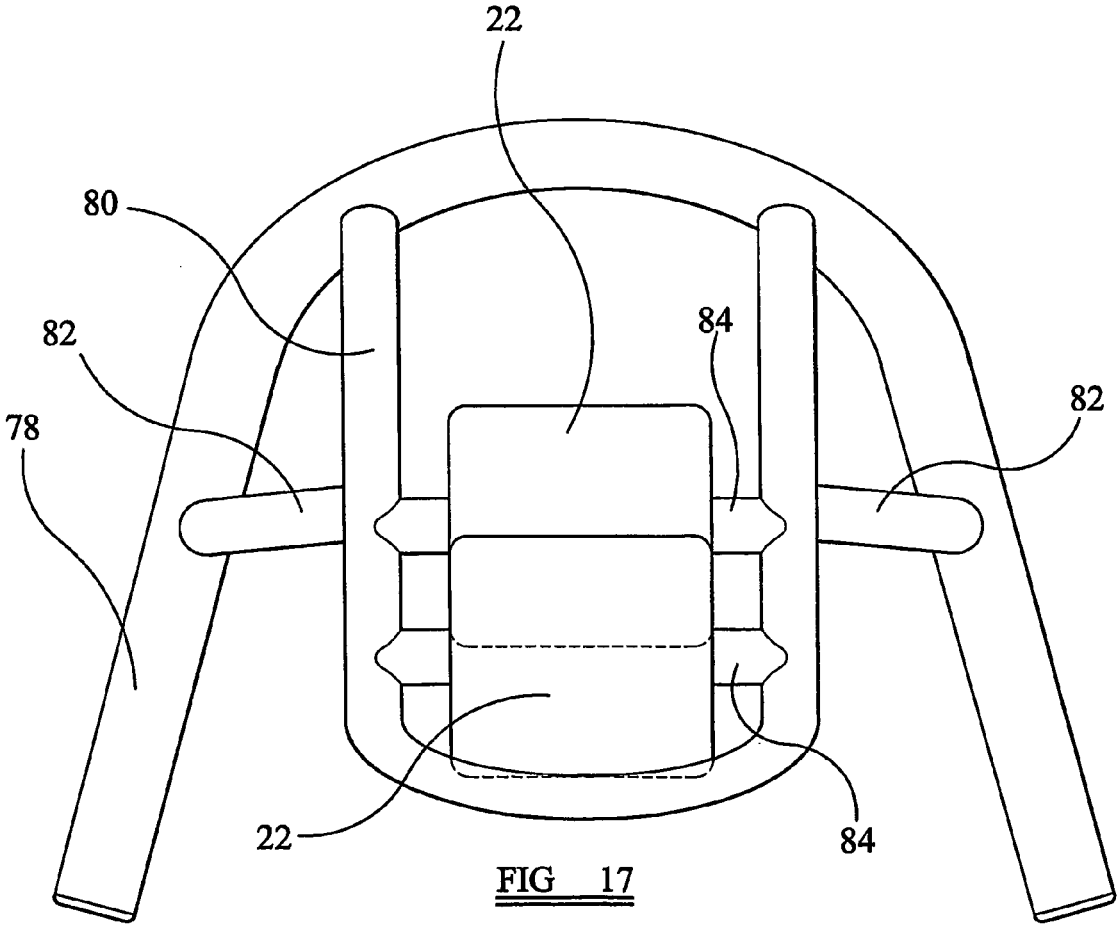
FIG 17

RETRACTABLE BARRIER SYSTEM

This invention relates to a retractable barrier system, and in particular to a system whereby a retractable barrier can be erected swiftly, when required.

Retractable barriers are available in a number of forms, and typically comprise a rotatable spool upon which a length of a flexible barrier material, for example in the form of webbing, is wound. A spring arrangement is usually provided to urge the spool to rotate in a direction to take up any slack in the barrier material. In use, the spool is fixed in a desired position and, when the barrier is to be erected, the free end of the barrier material is pulled to unwind barrier material from the spool, the free end of the barrier material being secured in a suitable position by using a suitable fastening device. As the material is drawn from the spool, the spool is rotated against the spring biasing thereof. When the barrier is no longer required, the barrier material is released by releasing the fastening device. The spring biasing of the spool causes the spool to rotate, the barrier material being wound onto the spool. In some applications the spool is located within a housing which is permanently secured to, for example, a wall, a piece of furniture or a permanent or semi-permanent structure. It is also common to mount such spools upon moveable posts to allow the erection of temporary barriers in any location including outdoors.

Barriers of this type are used in a range of applications, including queue or flow management in shops, airports, conference centres or arenas, and the like. Where there is a change in the flow of people through an area, there may be a requirement to alter the layout of the barriers used in queue or flow management. If the layout is to be changed rapidly in response to a change in queue or flow patterns, then it is desirable to use a barrier system capable of being reconfigured quickly. It is an object of the invention to provide a system capable of use in such circumstances or for short term intermittent use.

According to the present invention there is provided a retractable barrier system comprising a plurality of barrier posts interconnectable by flexible barrier material, and a dispenser device upon which the posts can be carried and from which the posts can be dispensed, in sequence, to erect a barrier. One of the posts is preferably connected to the dispenser device by flexible barrier material.

Each post conveniently carries one or more spring biased rotatable spools upon which flexible barrier material can be wound, a free end of the barrier material being securable to an adjacent post or securable to, for example, a wall mounted bracket or a free-standing anchor post by a suitable connector. One or more similar spools may be provided on the dispenser unit The connector is preferably of releasable form and may include a socket having an opening formed therein and a coupling member which can be fitted completely into the socket through the opening thereof, subsequent angular movement of the coupling member resulting the coupling member occupying an orientation in which it cannot pass through the opening.

The posts are preferably designed to be of a nestable form, thereby increasing the number of posts which can be carried in a compact fashion by the dispenser device.

The dispenser device may be wheeled, and may be arranged to permit retraction of the wheels or to allow the wheels to be locked against movement The dispenser device preferably includes a post support arrangement for carrying the posts. The post support arrangement may include arms which can, in one embodiment, be lowered to assist in loading the posts into or onto the dispenser device.

One or more display boards may be provided on the dispenser device. The or at least one of the display boards may be electrically powered or controlled. When electrically powered, the display board may be powered from a battery or storage device mounted upon the dispenser device, or may be solar powered. Where battery power is used, the battery may be rechargeable using, for example, a plug or socket which can be connected to a wall mounted socket or plug, or using solar energy. In an alternative arrangement, a conductor may extend along the barrier material to allow the transmission of electrical energy and/or control signals along the barrier to the display board.

The invention further relates to a flexible barrier material incorporating an electrical conductor, and to a connector comprising a housing having an opening therein and a coupling device which, in one orientation, can pass completely through the opening into the housing, subsequent angular displacement of the coupling device preventing passage of the coupling device through the opening.

The invention will further be described, by way of example, with reference to the accompanying drawings, in which:

FIGS. 15 to 17 are side, front and plan views, respectively of a post of an alternative barrier system.

Figure 1:
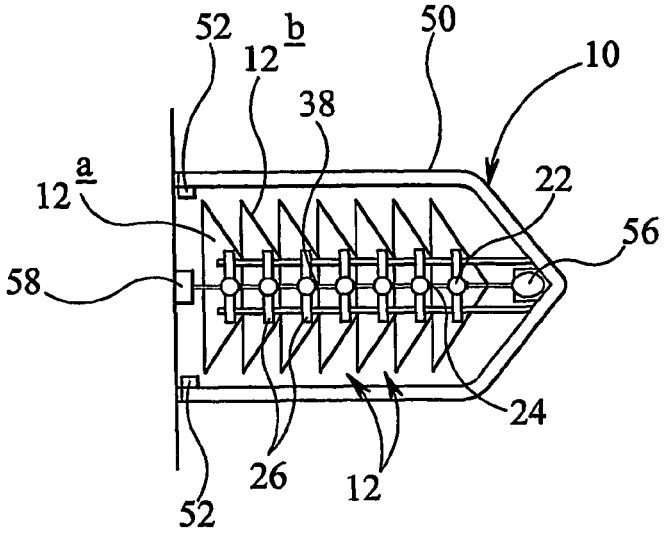
FIG. 1 is a diagrammatic plan view illustrating a retractable barrier system in accordance with one embodiment of the invention in a stowed condition.
Figure 6:
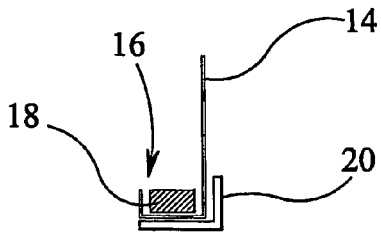
FIG. 6 is an enlarged view illustrating part of the post of FIG. 5.

Referring to the drawings, a retractable barrier system is shown which comprises a dispenser device 10 upon which, in the stowed condition shown in FIG. 1, is a plurality of posts 12. Each post 12 takes the form of sheet material, for example a sheet of steel, which has been folded to form two walls 14 of a generally pyramidal body. The lower edges of the walls 14 are turned inwardly as shown in FIG. 6 to form a channel 16 in which a ballast material 18 is provided. A rubber or rubber-like strip 20 is provided along the lower edges of the walls 14 and beneath the channel 16 to resist sliding movement of the post 12, in use, and also to minimise the risk of damage to a floor surface upon which the system is used.

At the apex of each post 12 is provided a generally cylindrical housing 22 containing a spring biased spool arrangement of any suitable form, a length of flexible barrier material in the form of webbing 24 being secured to the rotatable spool located within the housing 22.

The housing 22 of each post 12 is provided with a pair of laterally extending arms 26.

The free end of the webbing 24 associated with each post 12 carries a coupling member 28 of the type shown in FIGS.

7 and 9. As illustrated, the coupling member 28 includes a central body part 30 having a slot 32 provided therein through which the free end of the webbing 24 extends, the webbing 24 conveniently being folded and sewn to prevent removal of the coupling member 28 from the webbing 24. From the sides of the central part 30 extend a pair of flanges 34, the central parts. of which are provided with rounded pips 36.

Figure 8:
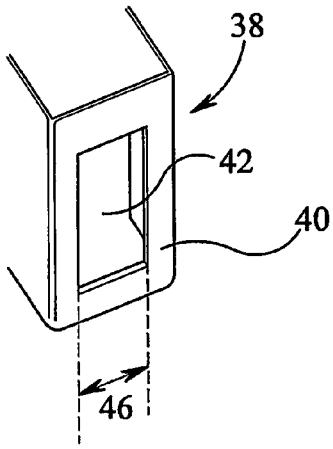
FIG. 8 is a perspective view of a housing.

Each post 12 has mounted thereon a socket 38 of form shown in FIG. 8. The socket 38 comprises a housing 40 having an opening 42 formed therein. The opening 42 is of dimensions tailored to the dimensions of the coupling member 28 so as to allow the coupling member 28 to be passed completely through the opening 42 by inserting the male-type the coupling member 28 sideways or side edge first into the opening 42 of the female-type socket 38. Once located completely within the housing 40, the rotation of the coupling member 28 through approximately 90 degree moves the coupling member 28 into an orientation in which it cannot pass through the opening 42 and so is secured within the housing 40 of the socket 38. To function in this manner, the dimension 44 shown in FIG. 9 should be slightly smaller than the width 46 of the opening 42, and the dimension 48 shown in FIG. 9 should be greater than the width 46 of the opening 42.

Figure 7:
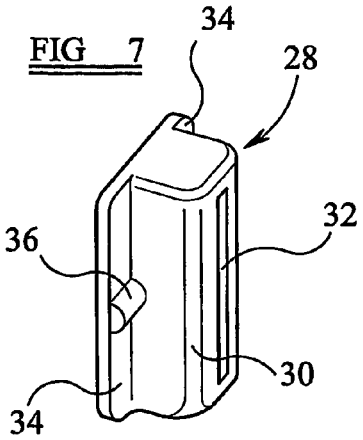
FIG. 7 is a perspective view illustrating a coupling member.
Figure 9:
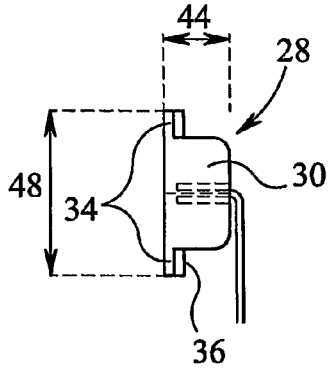
FIG. 9 is a plan view of the coupling member.

It will be appreciated that the connector arrangement shown in FIGS. 7 to 9 is releasable, but unintentional release of the connector arrangement 28/42 is very unlikely to occur.

As shown in FIG. 1, when stowed, the posts 12 are arranged with the male coupling member 28 of each post 12 connected to the female socket of an adjacent post 12.

The dispenser device 10 comprises a frame housing 50 carried by retractable wheels 52 to allow the housing 50 to be moved reasonably easily. The housing 50 is provided with a pair of dispenser arms 54 which extend parallel to one another. The arms 54 are adapted to cooperate with the arms 26 associated with each post 12 such that the posts 12 are carried by the dispenser device 10.

The dispenser device 10 is provided with a spool housing 56 containing a spool of design similar to the spools associated with the posts 12, the webbing 24 of the spool associated with the dispenser device 10 having, at its free end, a male coupling device of the type described hereinbefore which is received within the socket 38 of one of the posts 12.

The lower edge of the dispenser device 10 may be provided with a rubber or rubber-like material strip similar to that provided on the posts 12.

The system shown in FIG. 1 is intended for use in conjunction with a wall mounted socket 58 of form similar to that described hereinbefore. As shown, the male-type coupling member 28 associated with one of the posts 12 is received by the wall mounted female-type socket 58.

When the barrier system of the embodiment illustrated in FIG. 1 is to be erected, the dispenser device 10 is moved away from the wall. As the dispenser device 10 is moved, the webbing 24 associated with an end one 12*a* of the posts 12 is pulled from the spool until the webbing 24 is fully unwound from the spool. Continued movement of the dispenser device 10 will cause the first or end post 12*a*to be pulled from the dispenser device 10, and in webbing 24 being unwound from the spool of the next post 12*b*. Again, once the webbing 24 is fully unwound the post 12*b* will be pulled from the dispenser device 10.

Figure 2:
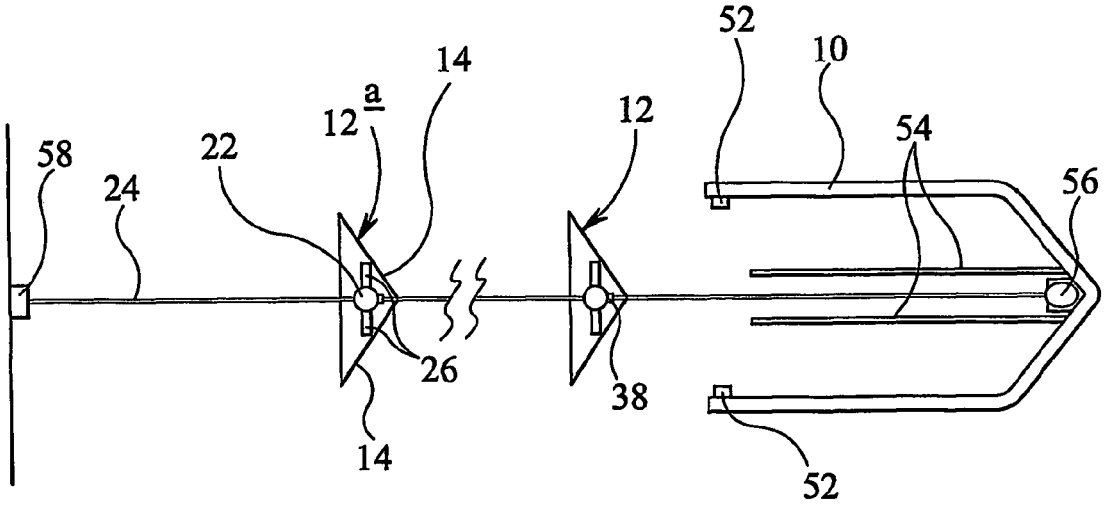
FIG. 2 illustrates the system of FIG. 1 in an extended condition.
Figure 3:
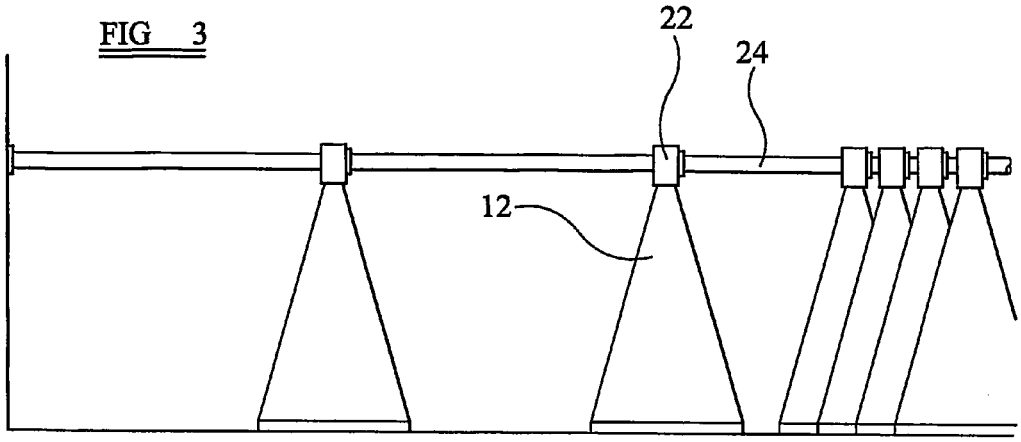
FIG. 3 is a diagrammatic side view illustrating dispensing of the barrier system.

Movement continues until either the barrier is fully extended (as shown in FIG. 2) or until the barrier has reached the desired length. Once either of these conditions has been reach, the wheels 52 of the dispenser device 10 are retracted, braked or locked to resist movement thereof.

As mentioned hereinbefore, the coupling members 28 are provided with pips 36. The provision of the pips 36 allows a degree of articulation between each male coupling member 28 and the associated female socket 38, thereby accommodating slight undulations and/or slopes in the surface upon which the system is to be used. This may be particularly advantageous where the system is used outside.

Figure 4:
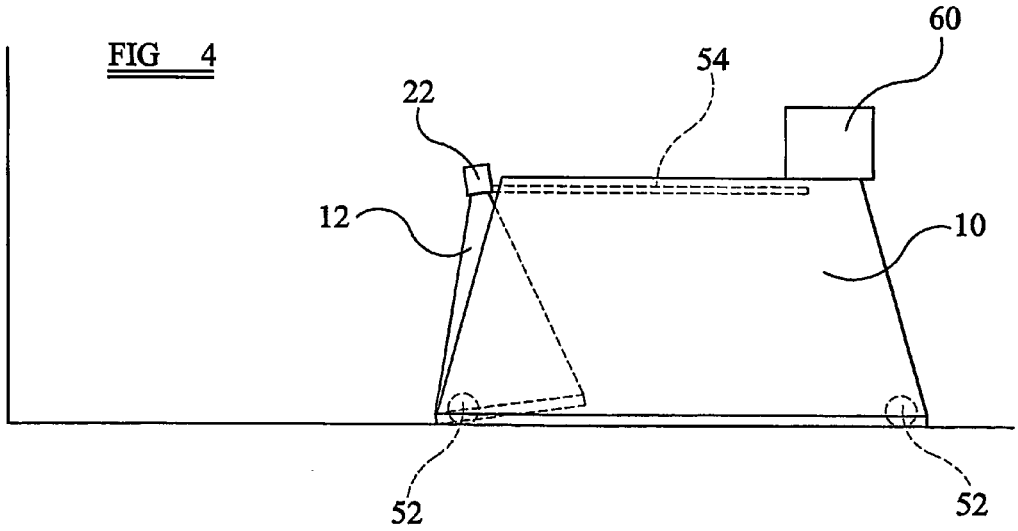
FIG. 4 is a diagrammatic side view illustrating retraction of the barrier system.
Figure 5:
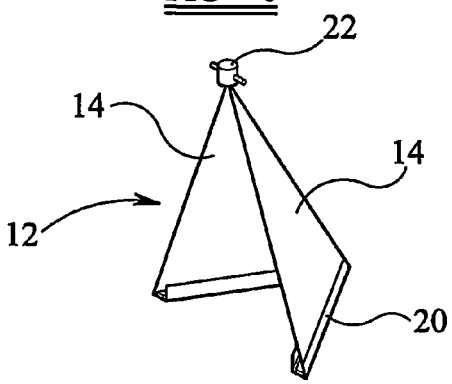
FIG. 5 is a perspective view illustrating a post.

To return the system to its stowed condition the wheels 52 of the dispenser device 10 are extended and the dispenser device 10 moved back towards its starting position. The initial movement results in webbing 24 being taken up onto the associated spool, such movement continuing until the arms 54 of the dispenser device 10 engage the arms 26 of one of the posts. Once such a position has been reached, continued movement of the dispenser device 10 causes the post 12 to tilt, as shown in FIG. 4. The tilting movement results in the post arms 26 lifting or rising slightly, due to the location of the post housing 22 forward of the rear tips of the side walls 14, the lifting movement being sufficient to allow the post arms 26 to ride onto the dispenser arms 54 to allow the post to be carried by the dispenser device 10. Movement of the dispenser device 10 continues until all of the posts 12 have been collected and returned to their stowed configuration shown in FIG. 1.

Although the illustrated arrangement includes a pair of arms 26 associated with each post 12, it may be possible to provide more post arms 26, or only a single arm 26.

As shown in FIG. 4, the dispenser device 10 conveniently carries one or more display boards 60. Although the display boards 60 may be arranged simply to support printed or hand written signage, they could take the form of electrically powered displays powered from, for example, batteries carried by the dispenser device 10. The batteries may be rechargeable, and the dispenser device 10 may include a plug or socket to allow the batteries to be recharged automatically when the dispenser device 10 is in a stowed condition. Alternatively, the display boards 60 may be solar powered. Another alternative is for the display boards 60 to be powered and/or controlled using one or more electrical conductors associated with and extending along the webbing 24. For example, a conductor may be secured to or woven into the webbing 24.

Although the arrangement described hereinbefore makes use of a single wall mounted socket 58 to which the webbing 24 of one of the posts 12 was already secured, systems are envisaged in which a number of sockets, for example a plurality of wall mounted sockets 58, are provided at appropriate locations. When the barrier is required, the dispenser unit 10 is moved to the desired location, the coupling member 28 associated with the end one of the posts 12 is secured to the chosen socket 38 and the dispenser unit 10 is then moved to erect the barrier as described hereinbefore. It is also envisaged that the system may be used in conjunction with a socket 38 mounted upon a free standing anchor post which could also be carried by the dispenser device 10 so that, when the barrier is to be erected, the dispenser device 10 is positioned at one end of the desired barrier location, the anchor post is removed from the dispenser device 10 and appropriately positioned, and the dispenser device 10 is moved away to erect the barrier.

Figure 10:
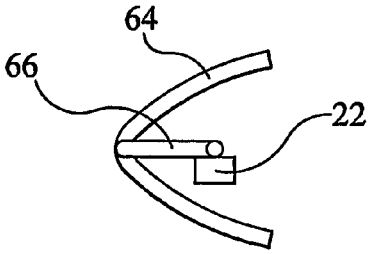
FIGS. 10 and 11 illustrate two alternative designs of post.
Figure 11:
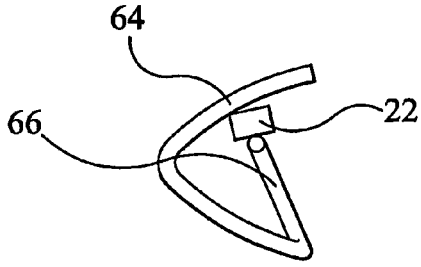

It will be appreciated that the design of post 12 described hereinbefore is advantageous in that the posts 12 are of a nestable design, part of each post 12 being receivable within an empty space formed in an adjacent post 12. Such a design allows an increased number of posts 12 to be carried by the dispenser device 10. It will be appreciated that the invention may be used with other post designs, and in particular other nestable post designs, for example of the type shown in FIGS. 10 and 11. These designs include a V-shaped base 64 from which an angled post member 66 extends, the upright carrying the spool housing. In the design of FIG. 10 the post member 66 extends from the apex of the base 64, the FIG. 11 arrangement having the post member 66 extending from one of the free ends of the base 64.

Figure 12:
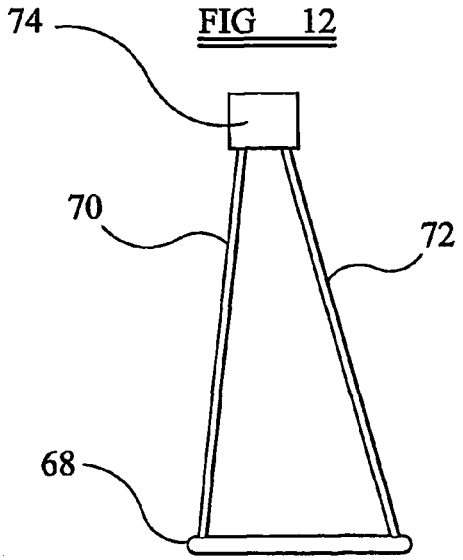
FIGS. 12 to 14 are side, front and plan views, respectively, of a further post design.
Figure 13:
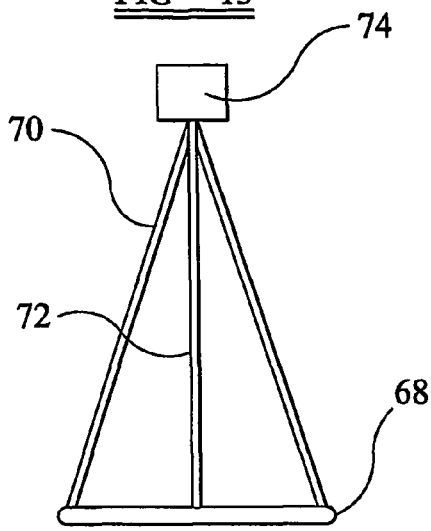
Figure 14:
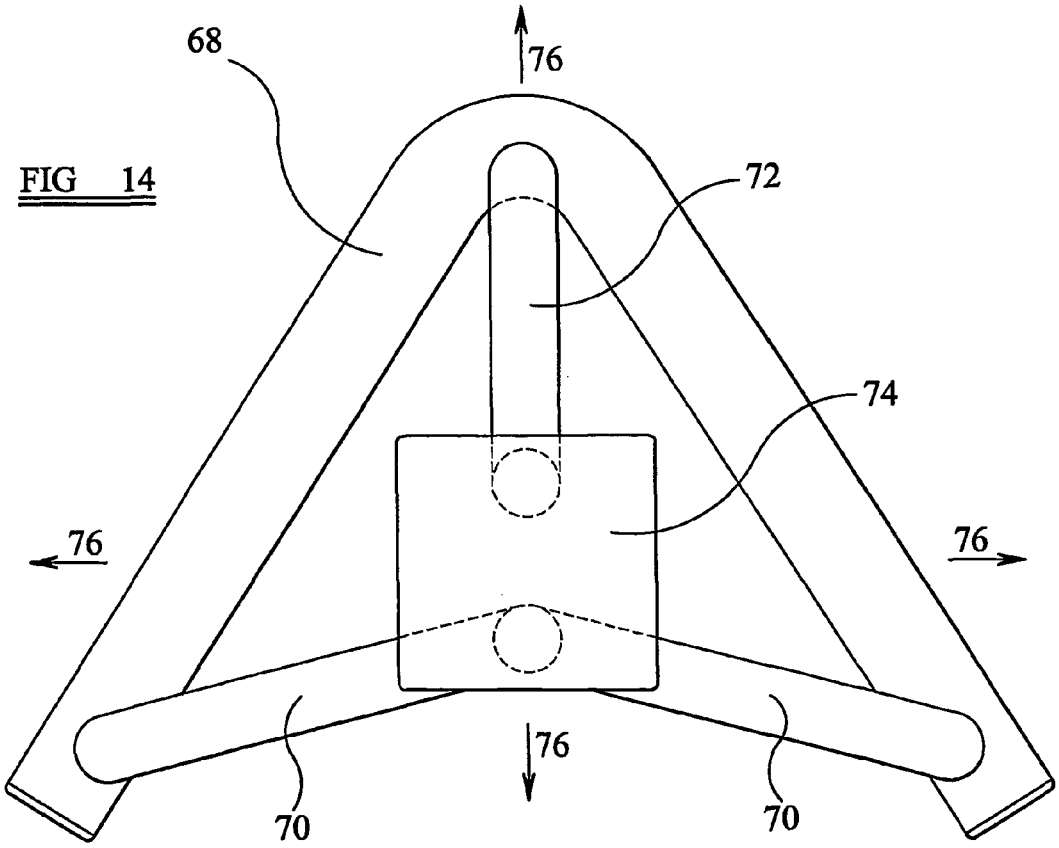

FIGS. 12, 13 and 14 illustrate a further alternative post design. This design includes a generally V-shaped base 68. A pair of side members 70 a secured close to the ends of the base 68, and a front support member 72 is connected to the base 68 at the apex of the V-shape. The side members 70 and front support member 72 together serve to support a post housing 74 containing the spool, etc and to which arms or other components to allow dispensing/collection of the posts 12 can be mounted. Conveniently, the base 68 and members 70, 72 are of weighted tubular or bar form. Arrows 76 illustrate some directions in which webbing 24 may be retracted from or connected to the post 12. It will be appreciated, however, that the arrows 76 are merely examples of suitable directions. As with the other post designs described hereinbefore, the arrangement of FIGS. 12, 13 and 14 is designed to allow the posts 12 to nest together.

Although the arrangements described hereinbefore make use of a single spool on each post 12, more spools could be provided on one or more of the posts. FIGS. 15 to 17 illustrate an alternative post design in which each post is provided with a pair of housings 22 containing spools, one spool housing being located close to the top of each post and the other spool housing being located at approximately half the height of the post. The webbing 24 associated with both of the housings 22 is connected or connectable, in use, to an adjacent one of the posts. The post comprises a generally inverted U-shaped base 78 from the front of which an inverted U-shaped, angled upright 80 extends. A pair of side member 82 serve to support the upright 80. Cross members 84 interconnect the limbs of the upright 80 and carry the post housings 22.

A number of modifications and alterations may be made within the scope of the invention. For example, in one envisaged arrangement, the post housing 22 is of a shape other than generally cylindrical as mentioned hereinbefore. Further, the arms 54 of the dispenser 10 arrangement may be adapted to permit a degree of lifting and lowering thereof to assist in the collection of the posts 12. In such an arrangement, the dispenser device 10 is moved to a position adjacent a post 12 to be collected, the dispenser arms 54 are lowered to a height slightly lower than the arms 26 of the post, and the dispenser device 10 is moved to a position in which the dispenser arms 54 thereof are positioned below the post arms 26. The dispenser arms 54 can then be raised to lift the post 12 from the ground and allow continued movement of the dispenser device 10 to collect other posts 12.

A further alternative is to replace the post arms 26 with an alternative support means to allow the posts 12 to be carried by the dispenser device 10. One possible technique may be to provide each post 12 with an opening or openings into or through which the dispenser arms 54 may extend when the post 12 is carried by the dispenser device 10. The opening(s) may be provided in a socket 38 secured to the post 12, if desired. It will further be appreciated that, depending upon the position of the opening(s), only a single dispenser arm 54 may be required in some possible embodiments.

In each of the arrangements described hereinbefore, the posts 12 are designed such that the webbing 24 is dispensed from the rear side of the post 12, in the direction of movement of the dispenser device 10 during dispensing. However, it will be appreciated that this need not be the case and the webbing 24 could, for example, be dispensed from the front side of the post 12. In such an arrangement, if wall mounting is desired, it may be desirable to mount a spool onto the wall in a suitable location, the end of the webbing 24 of the wall mounted spool being securable to one of the posts 12. It will further be appreciated that the posts may be designed to allow webbing 24 to be secured to, for example, the sides thereof.

Although the term webbing is used frequently herein, other types of flexible elongate member may be used as the barrier material, and the invention is not restricted to the use of webbing for his purpose.

Further alternatives and modifications are possible within the scope of the invention.

The invention claimed is:

1. A retractable barrier system for temporary pedestrian guidance comprising:

a plurality of upright, free-standing barrier posts, first and second ones of said upright posts being interconnectable by a first length of elongate flexible barrier material and second and third ones of said upright posts being interconnectable by a second, separate and independent length of elongate flexible barrier material, and a dispenser device, including two parallel dispenser arms spaced a predetermined distance apart, upon which said upright posts are carried by said dispenser device, in use, and from which said upright posts are dispensed from said dispenser device, in use, in sequence, to erect a free-standing barrier;

wherein said barrier posts include a pair of post arms extending from said upright posts, horizontally, away from each other, and having a length such that the bottoms of the pair of post arms slidingly engage the tops of the dispenser arms.

2. A system according to claim 1, wherein the last post in said plurality of posts is releasably connectible to the dispenser device by flexible barrier material.

3. A system according to claim 1, wherein at least one of the posts carries one or more spring biased rotatable spools upon which flexible barrier material is wound, a free end of the barrier material being securable to a fixing.

4. A system according to claim 3, wherein the fixing is provided on another post.

5. A system according to claim 3, wherein the fixing comprises a wall mounted bracket or a free-standing anchor post.

6. A system according to claim 3, wherein one or more similar spools are provided on the dispenser device, for connection of the last post in the plurality of posts to the dispenser device by flexible barrier material.

7. A system according to claim 3, wherein the barrier material is securable to the fixing by a releasable connector.

8. A system according to claim 7, wherein the releasable connector includes a socket having a housing with an opening formed therein and a coupling member having a body and a flange which is fitted completely into the socket through the opening thereof, subsequent angular movement of the coupling member resulting in the coupling member occupying an orientation in which the flange cannot pass through the opening.

9. A system according to claim 1, wherein the posts are of a nestable form.

10. A system according to claim 1, wherein the dispenser device is wheeled.

11. A system according to claim 10, wherein the wheels of the dispenser device are retractable.

12. A system according to claim 10, wherein the wheels can be locked against movement.

13. A system according to claim 1, wherein the or each said arm is lowerable to assist in loading the posts into or onto the dispenser device.

14. A system according to claim 1, wherein one or more display boards are provided on the dispenser device.

15. A system according to claim 14, wherein the or at least one of the display boards is electrically powered or controlled.

16. A system according to claim 15, wherein when electrically powered, the display board is powered from one of a battery, a storage device mounted upon the dispenser device, or solar powered.

17. A system according to claim 16, wherein, where battery power is used, the battery is rechargeable.

18. A system according to claim 15, wherein a conductor extends along the barrier material to allow the transmission of electrical energy and/or control signals along the barrier to the display board.

19. A portable barrier dispensing system for temporary pedestrian guidance, comprising:

a. a portable dispenser including at least one horizontal dispenser arm;

b. a plurality of upright, free-standing barrier posts adapted to be carried by the dispenser and to be dispensed from or collected by the dispenser, the barrier posts having at least one post arm extending from a spool, and having a length such that the bottom of the post slidably engages the top of the dispenser arm, and c. a plurality of elongate lengths of flexible barrier material, first and second barrier posts being releasably interconnectable by a first length of flexible barrier material, and second and third posts being releasably interconnectable by a second, separate, and independent length of flexible barrier material to vary the length and orientation of the barrier; and whereby, in use, the dispenser device carries the posts, dispenses said posts in sequence to erect a free-standing barrier, and allows collection of said posts, in sequence, for storage.

20. A portable, configurable retractable temporary pedestrian guidance barrier dispensing system, comprising:

a. a portable dispenser including a dispenser housing with retractable wheels and a pair of parallel, spaced apart, rectilinear dispenser arms connected to the dispenser housing, the dispenser arms having a predetermined length and being oriented horizontally with respect to the floor; and b. a plurality of nestable, self standing, upright, free-standing barrier posts, adapted to be carried by the dispenser in a straight line and to be dispensed from or collected by the dispenser, via the dispenser arms, each barrier post including:

i. a self standing post housing;

ii. a flexible barrier webbing of a predetermined elongate length retractably connected to said post housing and having a coupling member disposed at its free end;

iii. a socket for releasably connecting a coupling member; and iv. a pair of post arms for slidingly engaging the dispenser arms to move the barrier post along, onto and off of the portable dispenser;

whereby first and second barrier posts are releasably interconnectable by the flexible barrier webbing of the second barrier post, and the second and a third barrier post are releasably interconnectable by the independent flexible barrier webbing of the third barrier post to vary the length and orientation of the barrier; and whereby, in use, the dispenser device carries said posts, dispenses said posts in sequence, by way of pulling forces between said posts caused by the interconnected retractable, flexible barrier webbing, of fixed predetermined length, to erect a freestanding barrier, and collects said posts in sequence for storage.

* * * * *